US005199812A

United States Patent [19]

McClellan

[11] Patent Number: 5,199,812

[45] Date of Patent: Apr. 6, 1993

[54] HYDRAULIC FIXED STRUT GAME

[75] Inventor: Byron K. McClellan, Salem, Ind.

[73] Assignee: The United States of America as represented by the Secretary of the Army, Washington, D.C.

[21] Appl. No.: 757,372

[22] Filed: Sep. 10, 1991

[51] Int. Cl.[5] ..... E02B 7/42

[52] U.S. Cl. ..... 405/101; 405/99

[58] Field of Search ..... 405/87, 94, 99, 100, 405/101, 102; 49/324, 356

[56] References Cited

U.S. PATENT DOCUMENTS

| | | | |
|---|---|---|---|
| 436,065 | 9/1890 | Bennett | 49/356 |
| 1,083,818 | 1/1914 | Fitch | 405/99 |
| 2,335,327 | 11/1943 | Wellons | 405/102 |
| 2,689,459 | 9/1954 | Mayo | 405/101 X |
| 4,352,592 | 10/1982 | Aubert | 405/102 |

*Primary Examiner*—David H. Corbin

*Attorney, Agent, or Firm*—Luther A. Marsh

[57] ABSTRACT

A movable dam gate hydraulically driven through a fixed strut to maintain or regulate a pool of water upstream of a dam, the present gate structure is placed in series as a plurality of units to form a desired length of movable dam. The dam gates of the invention are operated from within a dry gallery which contains a single hydraulic cylinder and associated electric motor-drive hydraulic pump and oil reservoir for each gate. The dry gallery allows ready inspection and maintenance of the hydraulic equipment and prevents silting of the equipment such as occurs in prior art wet recesses within which hydraulic cylinders and associated apparatus have been previously operated. The present gate and gate system can be operated remotely, thereby providing greater safety and convenience to personnel.

20 Claims, 2 Drawing Sheets

HYDRAULIC FIXED STRUT GAME

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

1. Field of the Invention

The invention relates generally to movable dam gates to forming a movable dam and particularly to a wicket gate operated hydraulically through a fixed strut.

2. Background of the Invention

Movable dam gates are common in the art and are utilized to maintain or regulate a pool of water upstream of a dam, such dam gates being raised to maintain maximum pool or lowered to pass maximum flows. Movable dam gates are also utilized to provide a navigable pass, gates adapted to this purpose often taking the form of wicket gates. Wicket gates which are generally available in the prior art must be lifted into position through utilization of a hoist mounted on a boat or bridge, the hoisting procedures used with such structure being slow and often unsafe. Hydraulically lifted wicket gates of the prior art have been driven through operating cylinders located in "wet" recesses. Hydraulic cylinders located in wet recesses are also subject to a more severe environment and are susceptible to sand and silt deposition on operating surfaces. Accordingly, prior hydraulically lifted wicket gates require maintenance and maintenance procedures must be conducted either in a "wet" environment or in a box structure within which the apparatus is dewatered. A need exists in the art for a movable dam gate and particularly for dam gates of the wicket type which are hydraulically operated both rapidly and safely. Further, a long-felt need exists in the art for hydraulically operated movable dam gates wherein the hydraulic apparatus associated with the gate can be maintained within an environment wherein siltation and other environmental factors do not require frequent and extensive maintenance and whereby required maintenance can be conducted within a dry environment without the need for extensive dewatering procedures. The disadvantages inherent in the prior art as noted above are obviated through a practice of the present invention which provides hydraulically operated movable dam gate structures operable both rapidly and safely and which require less frequent maintenance with such maintenance as is required taking place within a dry environment.

SUMMARY OF THE INVENTION

The invention provides a movable wicket dam gate structure and a gate system comprised of a plurality of the dam gate structures arranged as a series of units placed side by side to form a desired length of movable dam. The wicket gate structures of the invention are hydraulically operated through a fixed strut which interfaces with the downstream side of the gate structure by means of a guide track formed in the gate structure which cooperates with a bearing shoe or roller pivotally mounted to the distal end of the strut. The strut connects to a piston rod of an hydraulic cylinder, the hydraulic cylinder and associated hydraulic power unit and oil reservoir being maintained within a dry gallery formed in a concrete sill. Each of the wicket gate structures are hingedly mounted to the concrete sill and are operated through extension of the piston rod of each of the plurality of hydraulic cylinders to raise and lower the wicket gate structures or to hold said structures in intermediate positions.

The dry gallery within which the hydraulic cylinders and associated equipment are disposed allow rapid and easy access to the cylinders and associated equipment such that maintenance can be readily performed. Due to the fact that the cylinders and associated equipment are maintained within a dry environment, maintenance is less frequently required. The dry gallery further provides the ability to remotely control the operation of the several cylinders and thus the several wicket gate structures through the use of either dedicated electronics or telemetry systems. The movable dam thus formed by a series of the wicket gate structures can be operated through a simple pushbutton at a remote location. Operation of the movable dam and maintenance of the hydraulic equipment held within the dry gallery can thus be conducted during all river stages or weather conditions.

Accordingly, it is a primary object of the invention to provide hydraulically operated wicket dam gate structures arrangeable in series to form a movable dam and which are each operable through a fixed strut extending into a dry gallery formed within a concrete sill, each strut connecting with an associated hydraulic cylinder and hydraulic drive apparatus to operate the wicket gate structures.

Another object of the invention is to provide a movable dam formed of wicket gate structures which are hydraulically driven by hydraulic apparatus maintained within a dry environment formed within a concrete sill, the hydraulic apparatus being usually maintained within the dry environment.

A still further object of the invention is to provide a movable dam formed of wicket gate structures wherein hydraulic apparatus operating the wicket gate structures can be remotely controlled and are disposed within a dry environment which is not subject to siltation of the hydraulic apparatus.

Further objects and advantages of the invention will become more readily apparent in light of the following detailed description of the preferred embodiments.

DESCRIPTION OF THE PREFERRED EMBODIMENTS

Figure 1:
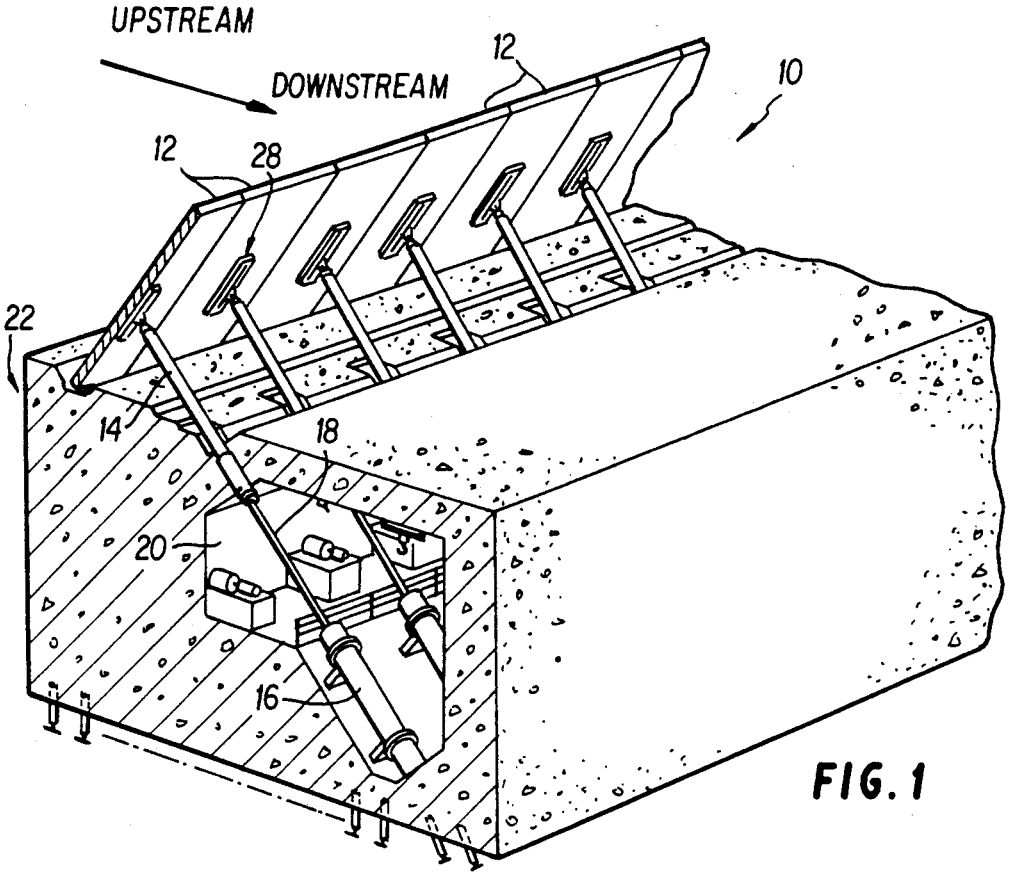
FIG. 1 is a perspective view in partial section of a series of wicket dam gates arranged to provide a movable dam, each gate being operable by associated hydraulic apparatus maintained within a dry gallery formed in a concrete sill supporting said gate.

Referring now to the drawings and particularly to FIG. 1, a movable dam is seen generally at 10 to be comprised of a series of wicket gates 12 movable between raised and lowered positions. Each of the wicket gates 12 is moved by a strut 14 movable along a fixed axis by means of hydraulic cylinder 16 and associated piston rod 18 which are disposed within dry gallery 20 of a concrete sill 22. This structure being described relative to FIG. 1 can also be seen in FIGS. 3 through 6 which illustrate the positions which the wicket gates 12 can assume in operation. The series of wicket gates 12 as seen in FIG. 1 cooperate to provide the movable dam 10, the gates 12 all being operable simultaneously or being singly operable according to operational requirements.

Each of the wicket gates 12 is preferably formed of steel, main structural members being structural steel tubes (not shown) running vertically of each wicket gate 12. Outer surfaces of the wicket gate 12 are formed of structural steel plate. Structures of this nature are conventional in the art, the structural steel tubes typically being laterally braced. As is also conventional in the art, the gate 12 can be constructed of materials including, but not limited to, steel, stainless steel, aluminum, wood, or either reinforced concrete or prestressed concrete.

Figure 7:
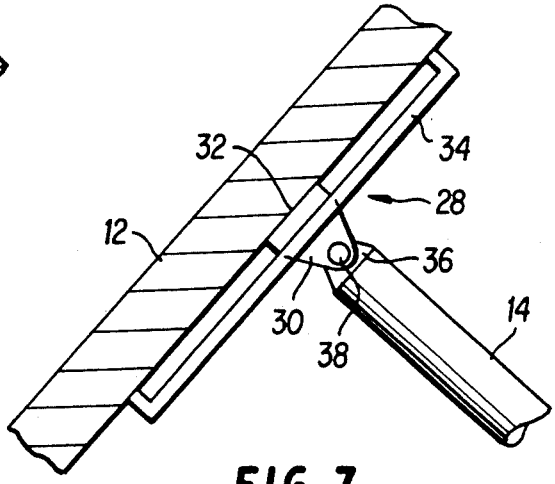

Each of the wicket gates 12 are pivotally connected to an upper surface of the concrete sill 22 by means of a hinge 24 connected to said gate 12 at the upstream end of the gate. The hinge 24 is disposed immediately downstream of a pocket 26 formed in the upper surface of the concrete sill 22, the pocket 26 accommodating the hinged end of the gate 12 on pivotal movement of said gate 12 from the zero elevation or fully lowered position. The gates 12 are thus anchored to the concrete sill through the hinges 24. The wicket gates 12 are disposed at spacings of approximately ±10'. Each wicket gate 12 is caused to move as indicated above by means of the strut 14. Each strut 14 is moved along a fixed axis extending longitudinally of the strut 14 by the hydraulic cylinder 16 as aforesaid, operation of the cylinder 14 to extend or retract the piston rod 18 causing the strut 14 to move either outwardly of or inwardly of the dry gallery 20. Accordingly, each of the wicket gates 12 are raised and lowered by one of the hydraulic cylinders 16 located within the water tight dry gallery 20 located inside the concrete sill 22. Each strut 14 maintains a fixed angle relative to upper surfaces of the concrete sill 22, the longitudinal axis of each of the struts 14 aligning with the longitudinal axis of the piston rod 18 and also of the hydraulic cylinder 16. Accordingly, the angle of the strut 14 relative to the wicket gate 12 must change during raising and lowering, the mechanism which allows this change of angle being schematically shown in FIG. 7. In FIG. 7, a guide track 28 is seen to be formed of structural steel angles or plates such that an opening is provided for receipt of a shoe mechanism 30 having a surface 32 which slides relative to opposing surfaces of the gate 12. A stop plate 34 is provided at each end of the guide track 28 to prevent movement beyond the fully raised position and the fully lowered position which is predetermined for the gate 12. The shoe mechanism is seen to be pivotally connected to distal end 36 by means of a pivot pin 38 or other suitable mechanism. The shoe mechanism 30 can alternatively take the form of a shoe and roller mechanism (not shown).

The strut 14 supports the wicket gate 12 in all positions, the strut being rigidly fixed at a 45° angle to the horizontal such that the strut 14 moves along an axis disposed at an angle of 45° to the horizontal. The longitudinal axis of the strut 12 coincides with this 45° axis. The strut is thus capable of moving along this fixed axis through a bore 40 formed in the concrete sill 22, the bore 40 communicating the dry gallery 20 with the exterior of the concrete sill 22 at the locus of entry of said strut 14 into said dry gallery 20. The strut 14 thus moves within the bore 40 to extend outwardly of the dry gallery 20 to raise the gate 12 or to move inwardly of the dry gallery 20 to lower the gate 12. A seal and bearing assembly 42 of substantially conventional design can be located within the bore 40 in order to provide bearing surfaces for movement of the structure 14 therewithin and to seal the dry gallery 20 such that water cannot flow into said gallery 20. Sealing and bearing structures conventionally available in the art can constitute the seal and bearing assembly 42, it therefore being unnecessary to describe this structure in detail. The seal and bearing assembly 42 will comprise packing glands (not shown) at the opening of the bore 40 on top slab surfaces of the concrete sill 22, such packing glands being provided on both the outside and inside faces thereof to prevent water from entering the gallery 20 and to keep clean the rollers (not shown) or other structure comprising portions of the seal and bearing assembly 42. Packing glands such as are useful in this environment are configured such that the glands may be cleaned or replaced as maintenance requires. Additionally, a conditioner seal box (not shown) which can be oil filled may be located on the external side of the seal and bearing assembly 42 such that said conditioner seal box can be easily removed and replaced and can thus provide additional sealing function.

Interiorly of the dry gallery 20, the anterior end of the strut 14 joins to a distal end of the piston rod 18 by means of a connecting collar 44. The connecting collar 44 can take the form of a conventional connector such as is useful within the use environment of the invention. It is preferred that the connecting collar 44 be capable of rapid disconnection and removal at any position of the gate 12 such that the structure can be "dogged off" so that the cylinder 16 can be disconnected and removed for maintenance or replacement. The connecting collar 44 can form a portion of a shear, bolt-type connection (not shown in detail) such as is conventional and such as would allow the strut 14 to telescope down over the piston rod 18 if subjected to excessive external loads.

Figure 2:
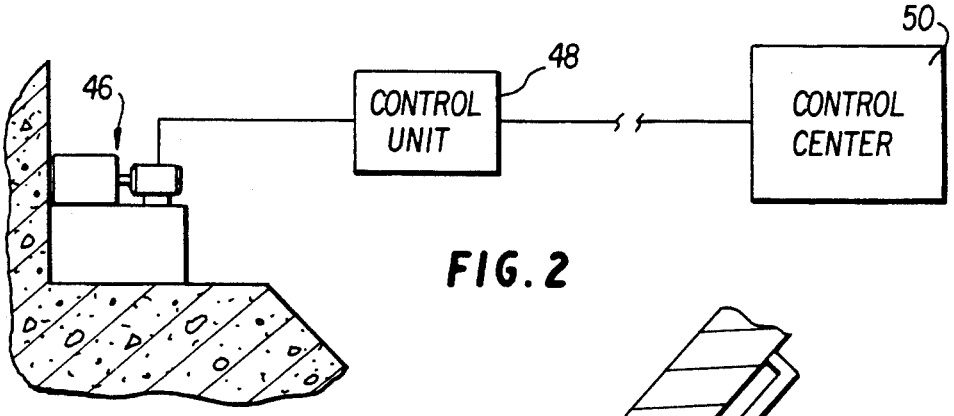
FIG. 2 is a diagram illustrating remote control of the hydraulic apparatus within the dry gallery of FIG. 1.

Hydraulic power to the hydraulic cylinder 16 is provided by a waterproof electric motor-driven hydraulic pump and oil reservoir assembly 46 located in the dry gallery 20. The assembly 46 can take the form cf conventional apparatus capable of driving the hydraulic cylinder 16. Each of the hydraulic cylinders 16 are of required capacity in stroke such that the wicket gates 12 can be readily lifted. As is seen in FIG. 2, each hydraulic pump and oil reservoir assembly 46 can be operated remotely through a control unit 48 which is connected to a control center 50 located remotely from the gallery 20. Connection between the control center 50 and the control unit 48 can be provided by a dedicated electrical line or telemetry apparatus such as is conventional in the art but which is not shown in the drawings. Accordingly, pushbutton control can be provided in the control center 50 which typically takes the form of a remote operations building. The wicket gates 12 can thus be controlled remotely either individually or as groups forming a movable dam such as the dam 10. Although not shown in the drawings, apparatus can be provided within the dry gallery 20 for local over-ride capability for each set of wicket gate 12, strut 14 and hydraulic cylinder 16.

The dry gallery 20 is maintained in a dry condition so that damage to the hydraulic cylinder 16 and assembly 46 can be prevented. Maintaining the hydraulic cylinder 16 and associated assembly 46 in a dry environment prevents damage to the hydraulic apparatus and allows routine inspection and maintenance of the hydraulic equipment. Accordingly, enhancement of the longevity of the various components comprising each of the cylinders 16 and associated assemblies 46 is realized. The apparatus located within the gallery 20 can be serviced and maintained during all river stages and weather conditions and are immediately accessible without the need for dewatering or other time consuming procedures by virtue of the fact that the gallery is maintainedin a dry condition. Access to the gallery 20 is therefore not delayed when maintenance and servicing is required.

Figure 3:
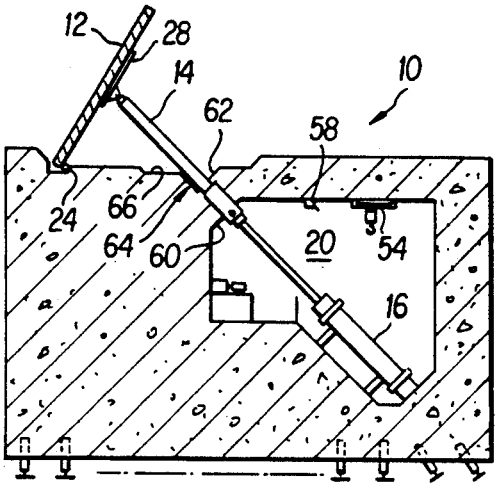
FIG. 3 is a side elevational view in partial section of a wicket gate configured according to the invention and shown at a position capable of maintaining maximum pool.
Figure 4:
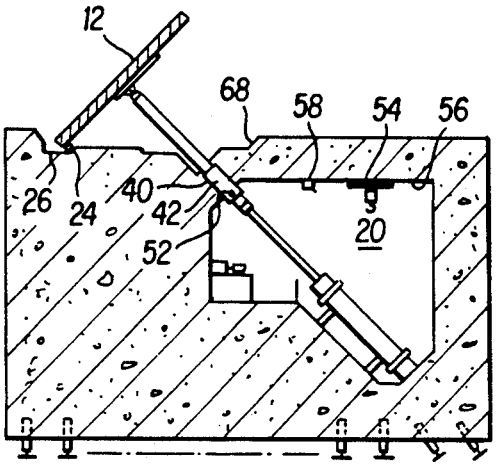
FIG. 4 is a side elevational view in partial section illustrating lowering of a wicket dam gate according to the invention to a 45° position.
Figure 5:
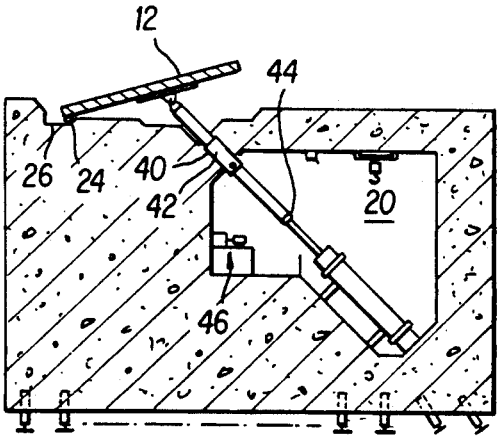
FIG. 5 is a side elevational view in partial section illustrating lowering of a movable dam gate according to the invention to a lowered position of approximately 15° elevation.
Figure 6:
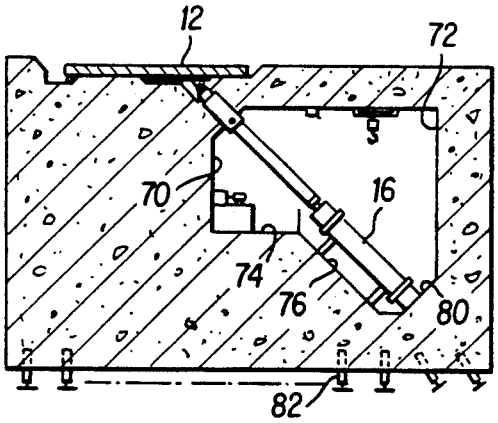
FIG. 6 is a side elevational view in partial section of a movable dam gate lowered to a zero degree elevation to provide or to provide a navigable pass; and, FIG. 7 is a schematic view illustrating a detail of a connection between a fixed strut and a wicket dam gate according to the invention which allows a strut to be maintained at a fixed angle relative to a concrete seal but with the angle between the strut and the wicket gate varying according to the position of the wicket gate.

The hinged wicket gates 12 in a fully raised position will be disposed at a 60° angle, plus or minus, to the horizontal and leaning in the downstream direction as is readily seen in FIG. 3. Retraction of the piston rod 18 of the cylinder 16 causes the strut 14 to move interiorly of the gallery 20 to lower the gate 12 to an angle such as 45° as seen in FIG. 4, 15° as seen in FIG. 5, or even a zero elevation as seen in FIG. 6. A dogging device (not shown) can be provided at the top slab of the sill 22 in order to lock the strut 14 in either the fully raised position or in any desired position other than the fully raised position. Dogging mechanisms include props either on the back of the wicket gate 12 or latches located in the dry gallery 20. Such dogging mechanisms are conventional and need not be shown in detail herein. A suitable dogging mechanism can be provided by dogging pins such as are generally shown at 52 and which extend through the strut 14 and piston rod 18 to prevent relative movement therebetween at a desired located. It should be understood, however, that the hydraulic system represented by the hydraulic cylinder 18 and the pump and oil reservoir assembly 46 can be designed to support the wicket gate 12 in the fully-raised position especially to accommodate emergency operation of the wicket gates.

In operation, each of the struts 14 are subjected to both axial and lateral forces due to the changing angle between said strut 14 and the wicket gate 12. The strut 14 is configured to resist the resulting axial load and moment imposed by these axial and lateral forces. The moment will be at a maximum when the wicket gate 12 is in the fully-raised position, that is, the 60° position illustrated in FIG. 3. This moment is resisted by the seal and bearing assembly 42 located in the bore 40 in the top slab of the concrete sill 22, the moment being transferred through the strut to the assembly 42 and thus into the slab comprising the concrete sill 22. The hydraulic cylinder 16 can therefore be designed to resist only the axial load of the strut 14.

The concrete sill 22 is preferably formed of reinforced concrete, the width of the sill 22 being chosen for stability and to enable the dry gallery 20 to be formed of a size sufficient to contain the series of hydraulic cylinders 16 and assemblies 46. Gravity drainage and sump pumps (not shown) can be provided as needed within the gallery 20 to maintain the gallery 20 in a dry condition. The arrangement of apparatus within the dry gallery 20 can be seen to be relatively simple and uncomplicated thus providing open,easily accessible space around the cylinders 16 and assemblies 46. In order to facilitate original installation as well as maintenance and replacement of the cylinders 16, a bridge crane 54 is provided in horizontal ceiling 56 of the gallery 20. Ventilation of the gallery 20 can be provided by ventilators 58 also disposed in the ceiling 56.

As can best be seen in FIGS. 1 and 3 through 6, the ceiling 56 forms an angled ceiling portion 60 at the upstream end of said gallery 20, the angled ceiling portion 60 defining a surface which is parallel to a downstream angled slab surface 62 comprising a surface portion of a V-shaped trough 64 formed in upper slab surfaces of the sill 22. The bore 40 within which the strut 14 moves is formed normal to the angled ceiling portion 60 and the downstream angle slab surface 62 of the trough 64 and extends therethrough to receive the strut 14. The upstream angled slab surface 66 of the trough 64 is disposed at anangle of45° to the horizontal in order that the strut 14 can move through the trough 64. The angled ceiling portion 60 is also located at an angle of 45° to the horizontal. The trough 64 is preferably provided with a flattened raceway 66 which can extend along the length of the concrete sill 22 and which can extend upstream of the trough 64 to communicate with the pocket 26, thereby forming a depression into which the gate 12 fits on full lowering of the gate 12 as is seen in FIG. 6. A downstream notch 68 can also be provided relative to the trough 64 in order to accommodate the distal end of the gate 12 on full lowering thereof. It will be understood by those of ordinary skill in the art that the upper slab surface of the concrete sill 22 can be configured other than as described herein in order to accommodate the gates 12 at the fully lowered position as well as those positions between and including the fully raised position.

The gallery 20 is further seen to comprise parallel side walls 70 and 72, the side wall 70 extending vertically downwardly from the termination of the angled ceiling portion 60 while the side wall 72 extends vertically down from the ceiling 56 at the end thereof opposite the angled ceiling portion 60. The side wall 70 terminates and extends horizontally to form an upper floor 74, the upper floor 74 terminating to form an angled floor 76, the angle of the floor 76 being 45° . The hydraulic cylinders 16 are mounted to the floor 76 and parallel thereto, thereby providing alignment between the longitudinal axes of the hydraulic cylinders 16, piston rods 18 and struts 14. A lower floor 78 terminates the angled floor 76 near the downstream end of the hydraulic cylinders 16 to provide a horizontal surface for maintenance of at least certain portions of the cylinders 16. The lower floor 78 is bounded by an angled downstream floor 80 which merges into the vertical side walls 72, thereby completing the shape of the dry gallery 20. The geometrical shape of the dry gallery 20 as is seen in section in the drawings allows an advantageous arrangement of the cylinders 16 and of the assemblies 46 as well as other apparatus located within the gallery 20. The volume thus provided by the shape of the dry gallery allows easy access to the apparatus within the gallery. It can further be seen in FIGS. 1 and 3 through 6 that the concrete sill 22 is held in place on a river bed by means of conventional anchors 82.

It is to be understood that the invention can be practiced other than as explicitly shown and described herein, the scope of the invention being defined by the appended claims.

What is claimed is:

1. A movable dam gate system, comprising:

a sill disposed in a moving body of water, the sill having a dry internal gallery chamber formed therein;

a wicket gate means mounted to an upper surface of the sill for maintaining or regulating a pool of water within the body of water;

hinge means attaching the wicket gate means to the sill for providing a pivotal connection therebetween, the hinge means being attached to the gate means and sill at upstream portions thereof;

a movable strut mounted to the sill at a fixed angle thereto and having a distal end movably connected to the wicket gate means, said strut forming a watertight seal with said sill; and hydraulic means disposed within the gallery chamber and comprising an hydraulic cylinder and piston rod for lifting the wicket gate means, the piston rod being connected to an anterior end of the fixed strut, force for lifting the wicket gate means being transmitted from the hydraulic means through the strut to the gate means.

2. The system of claim 1 and further comprising:

control means a portion of which is disposed within the dry gallery chamber and operatively connected to the hydraulic means and a portion of which is disposed at a location exteriorly of the gallery chamber for remotely controlling operation of the hydraulic means and thus operation of the wicket gate means.

3. The system of claim 1 wherein a plurality of the wicket gate means are disposed in juxtaposed relation along upper surfaces of the sill to form a movable dam, hydraulic means connected to each of the wicket gate means being disposed within the dry gallery chamber.

4. The system of claim 1 wherein the hydraulic means further comprise hydraulic pump and oil reservoir means disposed interiorly of the dry gallery chamber and operatively connected to the hydraulic cylinder.

5. The system of claim 1 and further comprising seal and bearing means disposed in a bore formed in a portion of the sill for mounting the strut at the fixed angle relative to the sill and movably within the bore, the strut extending exteriorly of the dry gallery chamber on extension of the piston rod to raise the wicket gate means and extending interiorly of the dry gallery chamber on withdrawal of the piston rod to lower the wicket gate means.

6. The system of claim 1 and further comprising guide means mounted to the downstream wall of the wicket gate means for guiding the distal end of the strut relative to the gate means on raising or lowering of said gate means, the system further comprising guide shoe means mounted to the distal end of the strut and being received within the guide means for movementwithin the guide means, thereby allowing the strut to remain at an angle fixed relative to the sill on raising or lowering of said gate means.

7. The system of claim 1 wherein the dry gallery chamber is at least partially defined by a lower floor surface inclined at an angle identical to the angle of the fixed strut, the hydraulic cylinder being mounted to the lower floor surface with the longitudinal axis of the cylinder being parallel to the surface of the lower floor surface and aligned with the longitudinal axis of the strut.

8. The system of claim 7 wherein in the lower floor surface terminates upstream in an upper horizontal floor surface, portions of the hydraulic means being mounted to the upper horizontal floor surface.

9. The system of claim 8 wherein the lower floor surface terminates downstream in a lower horizontal floor surface, the lower horizontal floor surface providing an area near the anterior end of the hydraulic cylinder for access to said cylinder.

10. The system of claim 9 wherein the lower horizontal floor surface terminates downstream in an angled floor surface which is parallel to the inclined lower floor surface, the anterior end of the hydraulic cylinder resting against the angled floor surface.

11. The system of claim 10 wherein the upper horizontal floor surface terminates upstream in a vertical wall, the vertical wall terminating in an upper ceiling surface inclined at an angle such that the longitudinal axes of the hydraulic cylinder and strut are perpendicular to the upper ceiling surface, the upper ceiling surface having a bore formed therein through which the strut is sealingly received and mounted for movement along the longitudinal axis thereof.

12. The system of claim 11 and further comprising seal and bearing means disposed in the bore for mounting the strut at the fixed angle relative to the sill and movably within the bore, the strut extending exteriorly of the dry gallery chamber on extension of the piston rod to raise the wicket gate means and extending interiorly of the chamber on withdrawal of the piston rod to lower the gate means, the seal and bearing means further sealing the bore to maintain the gallery chamber in a dry condition.

13. A movable dam gate, comprising:

a sill having a dry internal gallery chamber;

a wicket gate hingedly mounted to the sill at the upstream end thereof;

a strut mounted to the sill at a fixed angle thereto and having a distal end movably connected into the gallery chamber through a bore formed in the sill, said strut forming a watertight seal with said bore; and means connected to the anterior end of the strut and disposed internally of the gallery chamber for moving the strut to raise or lower the wicket gate.

14. The gate of claim 13 and further comprising means for sealing the gallery chamber to maintain the chamber in a dry condition.

15. The gate of claim 14 wherein a plurality of the wicket gates are disposed in juxtaposed relation along upper surfaces of the sill and a plurality of the strut moving means are disposed within the dry gallery chamber, one each of the strut moving means driving one each of the wicket gates through one of a plurality of struts one each of which connects each wicket gate to each strut moving means.

16. The gate of claim 15 and further comprising control means a portion of which is disposed within the dry gallerychamber and operatively connected to the strut moving means and a portion of which is disposed at a location exteriorly of the gallery chamber for remotely controlling operation of the strut moving means and thus the wicket gates.

17. The gate of claim 16 wherein the strut moving means each comprise an hydraulic cylinder and piston rod, each piston rod being connected to an anterior end of each strut, the longitudinal axes of each hydraulic cylinder, piston rod and strut being aligned, force for lifting each wicket gate being transmitted from the hydraulic cylinder and piston rod through the strut to the wicket gate.

18. The gate of claim 17 wherein the strut moving means further comprise hydraulic pump and oil reservoir means operatively connected to the hydraulic cylinder for driving said cylinder and piston rod, the entirety of the strut moving means being disposed within the gallery chamber in a dry condition.

19. The gate of claim 18 and further comprising guide means mounted to the downstream wall of the wicket gate for guiding the distal end of the strut relative to the guide means on raising and lowering of said gate, and further comprising guide shoe means mounted to the distal end of the strut and being received within the guide means for movement within the guide means, thereby allowing the strut to remain at an angle fixed relative to the sill on raising or lowering of said gate.

20. The gate of claim 19 wherein the sealing means are disposed in a bore formed in a portion of the sill and receiving the strut therewithin at the fixed angle relative to the sill and movably within the bore, the strut extending exteriorly of the dry gallery chamber on extension of the piston rod to raise the wicket gate and extending interiorly of the chamber on withdrawal of the piston rod to lower the gate.

* * * * *